US008479916B2

(12) United States Patent
Williams

(10) Patent No.: US 8,479,916 B2
(45) Date of Patent: Jul. 9, 2013

(54) PRODUCT DISPLAY PACKAGE

(75) Inventor: Nicholas Williams, Turin, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 182 days.

(21) Appl. No.: 12/908,264

(22) Filed: Oct. 20, 2010

(65) Prior Publication Data

US 2012/0097559 A1 Apr. 26, 2012

(51) Int. Cl.
*A45C 11/26* (2006.01)
*B65D 73/00* (2006.01)

(52) U.S. Cl.
USPC ..... 206/349; 206/463; 206/464

(58) Field of Classification Search
USPC ..... 206/349, 461, 463, 462, 783, 471, 206/379
See application file for complete search history.

(56) References Cited

U.S. PATENT DOCUMENTS

| | | | | |
|---|---|---|---|---|
| 3,239,177 | A * | 3/1966 | Samsing | 211/13.1 |
| 4,046,251 | A * | 9/1977 | Bruml | 206/780 |
| 4,312,449 | A | 1/1982 | Kinderman | |
| 4,445,611 | A * | 5/1984 | Shofu | 206/369 |
| 4,739,883 | A | 4/1988 | Mohs et al. | |
| 5,152,397 | A * | 10/1992 | Mayled | 206/486 |
| D365,020 | S * | 12/1995 | Dinand | D9/689 |
| 6,202,842 | B1 | 3/2001 | Pirro et al. | |
| 6,345,719 | B1 * | 2/2002 | Jaycox | 206/570 |
| 7,195,120 | B2 | 3/2007 | Cunningham et al. | |
| 7,766,192 | B2 * | 8/2010 | Lecoutre et al. | 206/464 |
| 8,002,112 | B2 * | 8/2011 | Weaver et al. | 206/349 |
| 2004/0211735 | A1 | 10/2004 | Chandaria | |
| 2005/0252811 | A1 * | 11/2005 | Perbet | 206/461 |

FOREIGN PATENT DOCUMENTS

| | | | |
|---|---|---|---|
| EP | 1798001 | A1 | 6/2007 |
| GB | 2447811 | A | 9/2008 |

* cited by examiner

*Primary Examiner* — Mickey Yu
*Assistant Examiner* — Chun Cheung
(74) *Attorney, Agent, or Firm* — Harris Beach PLLC

(57) ABSTRACT

A novel display package, packaged product, and method of packaging a product are hereby provided. In one illustrative embodiment, a package includes a base, a case, and a card that may be fitted together, for packaging a product positioned on the base and within the case. The base may include bottom and top engaging elements. The case may include a top end engaging element and a bottom end configured to engagingly fit with the top engaging element of the base. The card may include a lower section and an upper section, the lower section of the card configured to engagingly fit with the bottom engaging element of the base, and the upper section of the card configured to engagingly fit with the top end engaging element of the case. Display packages, packaged products, and methods are also disclosed in a variety of other embodiments.

11 Claims, 5 Drawing Sheets

PRODUCT DISPLAY PACKAGE

FIELD OF THE INVENTION

The present invention relates generally to a package for displaying a product, such as a firearm cleaning brush, scraper, pick, tip, swab, or other firearm maintenance tool, for example.

BACKGROUND

Various types of products may be advantageously displayed in packaging that securely and conveniently contains the product while also clearly showing the product and its features. Firearm maintenance tools, such as firearm cleaning brushes, scrapers, picks, tips, and swabs, are products with significant markets. Products such as firearm cleaning brushes and other firearm maintenance tools may benefit from specialized forms of packaging.

SUMMARY

A novel display package, packaged product, and method of packaging a product, such as a firearm cleaning brush, are hereby provided. In one illustrative embodiment, a package includes a base, a case, and a card that may be fitted together, for packaging a product positioned on the base and within the case. The base may include bottom and top engaging elements. The case may include a top end engaging element and a bottom end configured to engagingly fit with the top engaging element of the base. The card may include a lower section and an upper section, the lower section of the card configured to engagingly fit with the bottom engaging element of the base, and the upper section of the card configured to engagingly fit with the top end engaging element of the case. Display packages, packaged products, and methods are also disclosed in a variety of other embodiments.

This Summary is intended only to provide a brief overview of subject matter disclosed herein according to one or more illustrative embodiments, and does not serve as a guide to interpreting the claims or to define or limit the scope of the invention, which is defined only by the appended claims.

BRIEF DESCRIPTION OF THE DRAWINGS

For a further understanding of the objects of the various illustrative embodiments, reference will be made to the following detailed description which is to be read in connection with the accompanying drawings, where.

The drawings are not necessarily to scale, emphasis instead generally being placed upon illustrating the principles of various embodiments. In the drawings, like numerals are used to indicate like parts throughout the various views.

DETAILED DESCRIPTION OF ILLUSTRATIVE EMBODIMENTS

Firearm cleaning brushes, scrapers, picks, tips, swabs, and other firearm maintenance tools may particularly benefit from novel display packaging and associated methods of packaging such as those provided herein. The advantageous features and properties of a high quality firearm maintenance tool may be immediately apparent to potential customers on visual inspection, particularly when the tool is propped up in an upright position. At the same time, keeping the tool secure and clean within a transparent case with an involved packaging structure helps maintain the condition and safety of the tool. An attractive and sophisticated packaging also helps increase the perceived value of the enclosed product in the minds of potential customers and helps promote sales of the product. These illustrative objectives and advantages are served by features of various embodiments as further described below.

Figure 1:
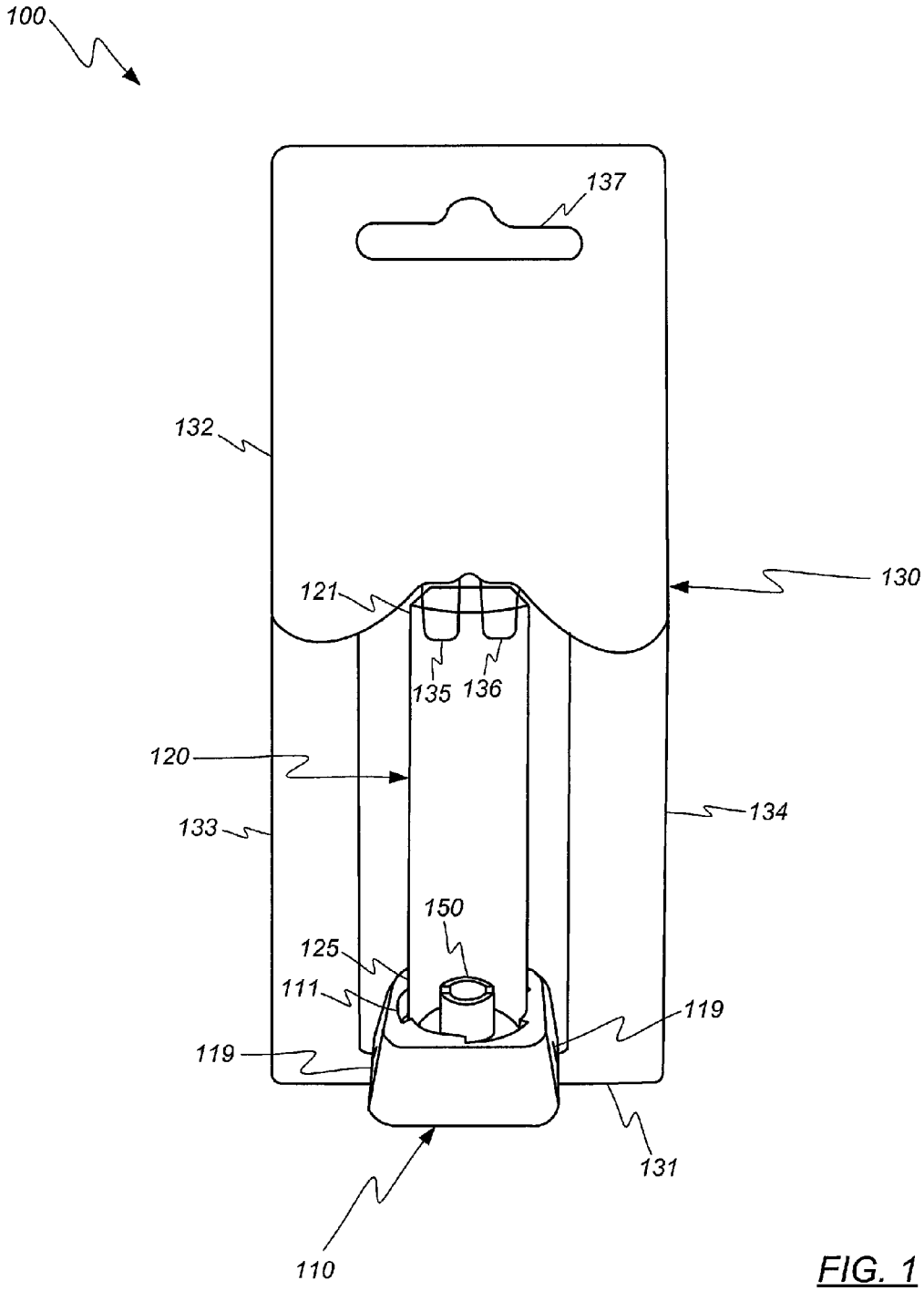
FIG. 1 depicts a product display package in an assembled state, in accordance with an illustrative embodiment.
Figure 2:
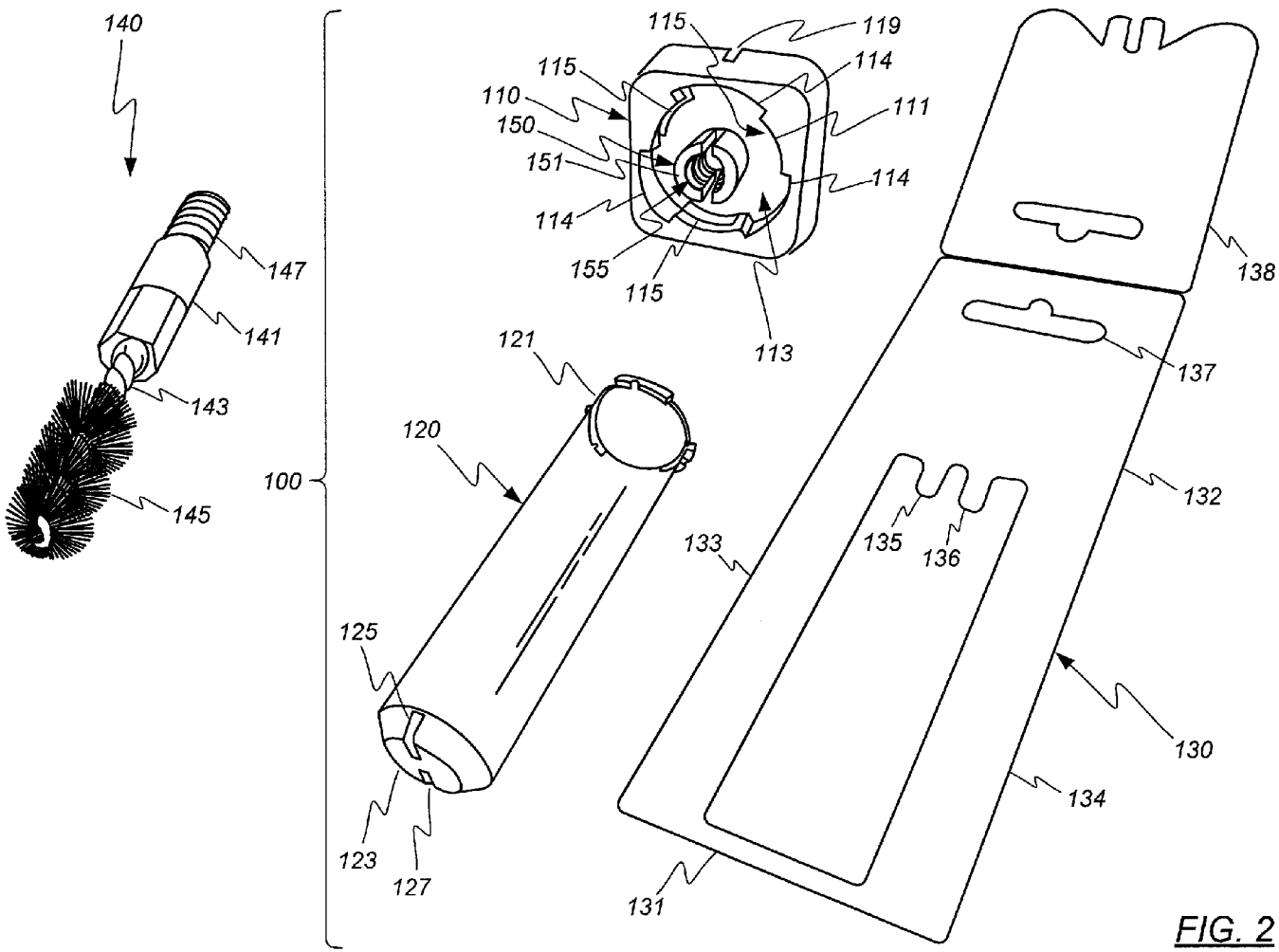
FIG. 2 depicts a product display package in a disassembled state and a firearm cleaning brush suitable for packaging in the product display package, in accordance with an illustrative embodiment.
Figure 3:
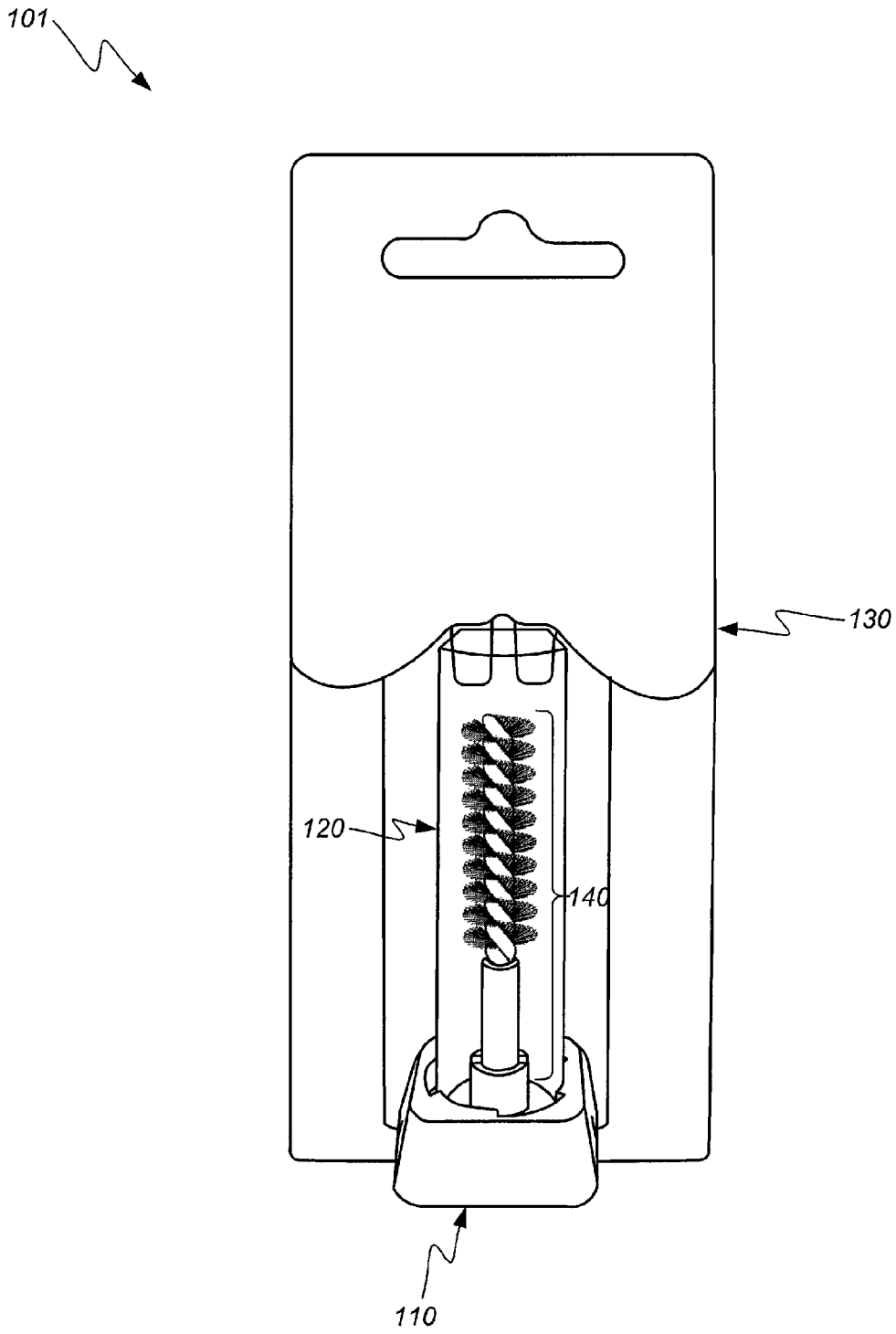
FIG. 3 depicts a product display package in an assembled state with a firearm cleaning brush packaged inside it, in accordance with an illustrative embodiment.

FIG. 1 depicts package 100 in an assembled state, in accordance with an illustrative embodiment. FIG. 2 depicts package 100 in a disassembled state, in accordance with the same illustrative embodiment of package 100 as FIG. 1, together with firearm cleaning brush 140 suitable for packaging in package 100. FIG. 3 depicts packaged product 101 comprising package 100 in an assembled form, with firearm cleaning brush 140 enclosed therein, in accordance with the illustrative embodiment of FIGS. 1 and 2. Package 100 includes base 110, case 120, and card 130. Firearm cleaning brush 140 is an illustrative example of a firearm maintenance tool or other product with which package 100 may be used. Firearm cleaning brush 140 is depicted in FIG. 3 positioned on base 110 and within transparent case 120. FIGS. 1, 2, and 3 show the elements of this illustrative embodiment in different contexts as they are further described below.

Various details of these components are described as follows with particular reference to FIG. 2, where these details may be more clearly seen. Some of these features are also referenced in FIG. 1 to further clarify correspondence of the features between the two views. Base 110 includes a rim 111 defining an interior cup section 113 on a top portion thereof, and a slot 119 in a bottom portion thereof. Rim 111 defining interior cup section 113 is an illustrative example of a top engaging element of base 110, and slot 119 is an illustrative example of a bottom engaging element of base 110, while other types of engaging elements may be used in other embodiments.

Case 120 has a transparent tubular body, in this illustrative embodiment. In other embodiments, case 120 may illustratively be partially opaque with one or more gaps or transparent windows thereon, for example, and may have a round cylindrical, rectangular, triangular, or other shape of cross-section, for example.

Case 120 includes bottom end 121 and top end 123. Case 120 has first slot 125 and second slot 127 disposed at top end 123. First slot 125 and second slot 127 are illustrative examples of top end engaging elements of the case, while other types of engaging elements may be used in other embodiments, such as a single slot, three or more slots, a snapping receiver, screw threading, or other types in different embodiments.

Bottom end 121 of the case is configured to engagingly fit within rim 111 and with interior cup section 113 of base 110. In this illustrative embodiment, interior cup section 113 of base 110 includes three surface-level, radially extended rim sections 114, and three corresponding adjacent subsurface radially extended slots 115. The bottom end 121 of case 120 also includes three radially extended tabs 122 configured to fit through the corresponding surface-level, radially extended rim sections 114 of base 110 and then, by rotation of case 120 relative to base 110, to engagingly and conformingly fit within the adjacent subsurface radially extended slots 115 of base 110.

In other embodiments, the interior cup section of the base may include only one, or two, or four or more surface-level, radially extended rim sections, and a corresponding number of adjacent subsurface radially extended slots, while the case may similarly include any corresponding number of radially extended tabs configured to fit through the surface-level, radially extended rim sections of the base and to engagingly fit within the radially extended slots of the base. In yet other embodiments, any of a wide variety of other types of engaging elements may be disposed on the top portion of the base and the bottom end of the case configured for engagingly fitting the two together.

The base further includes a mount 150 within the interior cup section 113, in this illustrative embodiment. Mount 150 may support a firearm maintenance tool thereon, such as firearm cleaning brush 140, as shown in FIG. 3. Mount 150 includes an annulus 151 defining a central opening 153 that comprises interior screw threading, as shown in FIG. 2. Firearm cleaning brush 140 has a threaded portion 147 with exterior screw threading, the threaded portion screwed into the central opening of mount 150, and thereby engagingly fitted with mount 150, as shown in FIG. 3, such that firearm cleaning brush 140 is supported upright on the base. Firearm cleaning brush 140 is thereby held upright by base 110, facilitating the display of its features to observers in a retail setting, for example.

While firearm cleaning brush 140 has a threaded portion 147 and may screw into mount 150 in this illustrative embodiment, firearm cleaning brushes and other firearm maintenance tools may also include a variety of other components that may allow them to engage with a mount in many other ways in other embodiments.

Card 130 includes lower section 131, upper section 132, and two side sections 133 and 134, in this illustrative embodiment. The side sections 133 and 134 extend between the lower section 131 and the upper section 132, thereby defining an interior gap in card 130 surrounded by the lower section 131, the upper section 132, and the two side sections 133, 134. Base 110 and case 120 are thereby positioned within the interior gap in the card 130 when base 110, case 120, and card 130 are engagingly fitted together, as shown in FIGS. 1 and 3.

Upper section 132 of the card 130 includes tabs 135, 136 positioned thereon. Tabs 135, 136 are illustrative examples of upper section engaging elements of card 130. Tabs 135, 136 are configured to conformingly fit with first slot 125 and second slot 127 of case 120. Upper section 132 of card 130 is thereby configured in this illustrative example to engagingly fit with first slot 125 and second slot 127 of case 120.

Upper section 132 of card 130 may also have a rack hole 137 disposed above the tabs 135, 136, in this illustrative embodiment, by which card 130 may be hung upon a rack (not shown in FIGS. 1-3). Upper section 132 of card 130 may further include a fold-over section 138, which is attached to the main body of card 130 along a folding border and folds along that border to be positioned conformingly adjacent to the main body of card 130, in this illustrative embodiment. Fold-over section 138 may extend enough to coincide with only a certain portion of card 130 such as upper section 132, as in this embodiment, or may extend more or less to coincide with other portions or the entirety of card 130, in other embodiments. As part of extending in conformity with the portion of card 130, fold-over section 138 may also include additional tabs and rack hole in parallel with tabs 135, 136 and rack hole 137 of upper section 132 of card 130. Upper section 132 may be considered to include fold-over section 138 and the tabs and rack hole of fold-over section 138 may be considered as part of, in tandem with or to substitute for tabs 135, 136 and rack hole 137 of upper section 132 of card 130 as they are applied in any part of the discussion herein, in accordance with different embodiments.

In other embodiments, the upper section of the card may be a plain, flat card section that fits directly into a single slot in the top of the case, similarly to how lower section 131 of card 130 fits into slot 119 in the bottom portion of base 110 in the embodiment of FIGS. 1 and 2, as an example for another embodiment, or the upper section of the card and the top of the case may use any of a variety of other engaging elements to engagingly fit together in other embodiments.

Card 130 may also contain printed matter on it, such as trademarks, a trade name, and descriptive and promotional material about the enclosed product, for example. Such printed matter may illustratively be disposed on fold-over section 138, some other portion of upper section 132, or any other portion of card 130, or elsewhere on package 100, in different embodiments.

Lower section 131 of the card 130 is configured to engagingly fit with slot 119 in the bottom portion of base 110. Lower section 131 of the card 130 and slot 119 of base 110 are configured to form a flat bottom surface when the lower section 131 of the card 130 is engagingly fitted into slot 119, such that insertion of card 130 into slot 119 does not alter the capability of base 110 to be placed on a normal surface and support package 100 in an upright position. The card 130 may be configured to engagingly fit with base 110 with any of a wide variety of other engaging means, such as slots and corresponding tabs on either component, snaps, tape, or any other type of engaging elements in other embodiments.

Firearm cleaning brush 140 may include a stem 141, a spiraling core 143, and bristles 145 positioned on core 143. Spiraling core 143 and threaded portion 147 may both be positioned in connection with stem 141. A wide variety of other arrangements and components of tools or other products may be used in other embodiments, and various embodiments include the package alone without the firearm cleaning brush 140 or any other particular firearm maintenance tool.

Figure 4:
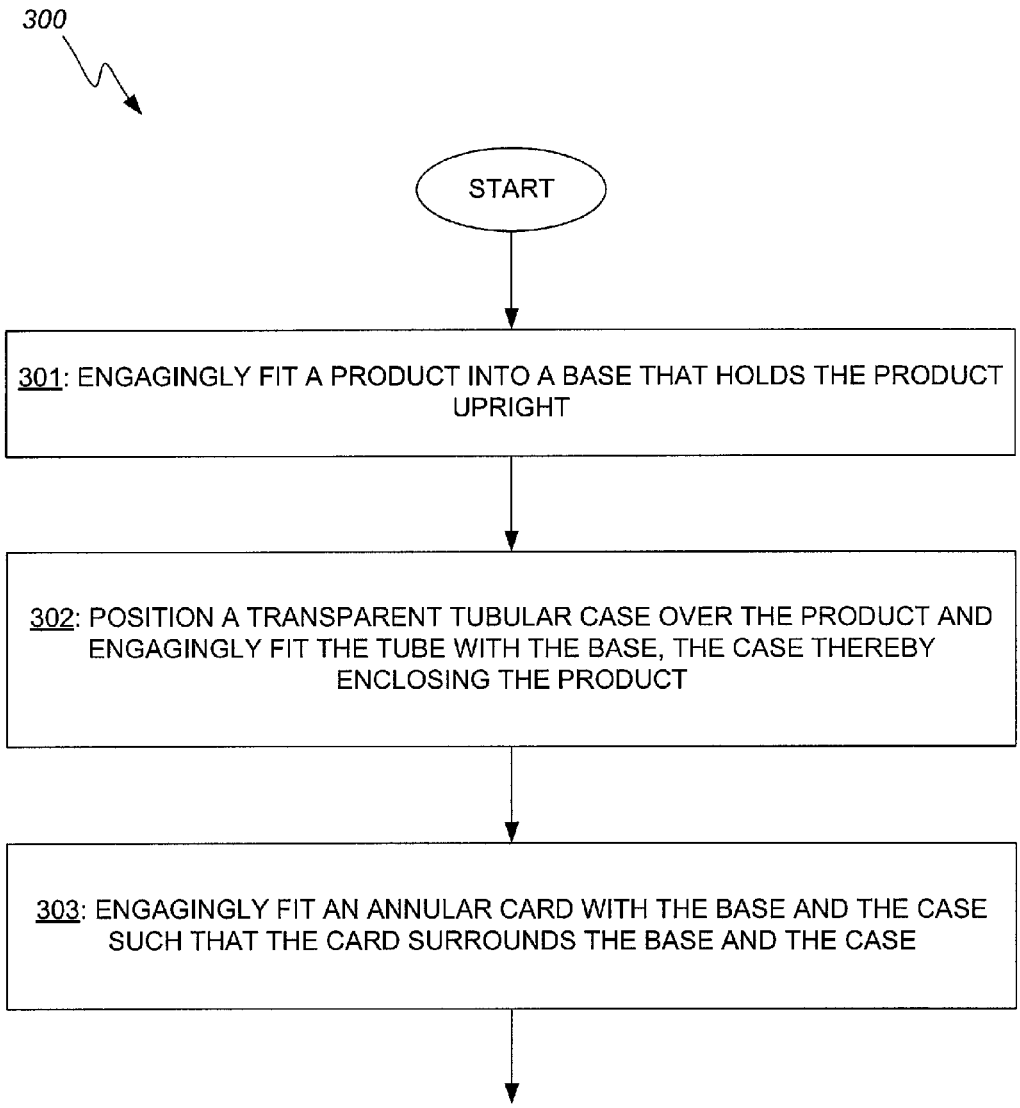
FIG. 4 depicts a flowchart for a method of packaging a product, in accordance with an illustrative embodiment.

FIG. 4 depicts a flowchart for a method 300 of packaging a product, in accordance with another illustrative embodiment. Method 300 includes step 301, of engagingly fitting the product into a base that holds the product upright; step 302, of positioning a transparent tubular case over the product and engagingly fitting the tube with the base, the case thereby enclosing the product; and step 303, of engagingly fitting an annular card with the base and the case such that the card surrounds the base and the case. Method 300 may be used with base 110, case 120, and card 130 in accordance with the illustrative embodiment of FIGS. 1-3, or with any of a wide variety of other base, case, and card elements with a broad range of engaging elements and other characteristics.

Figure 5:
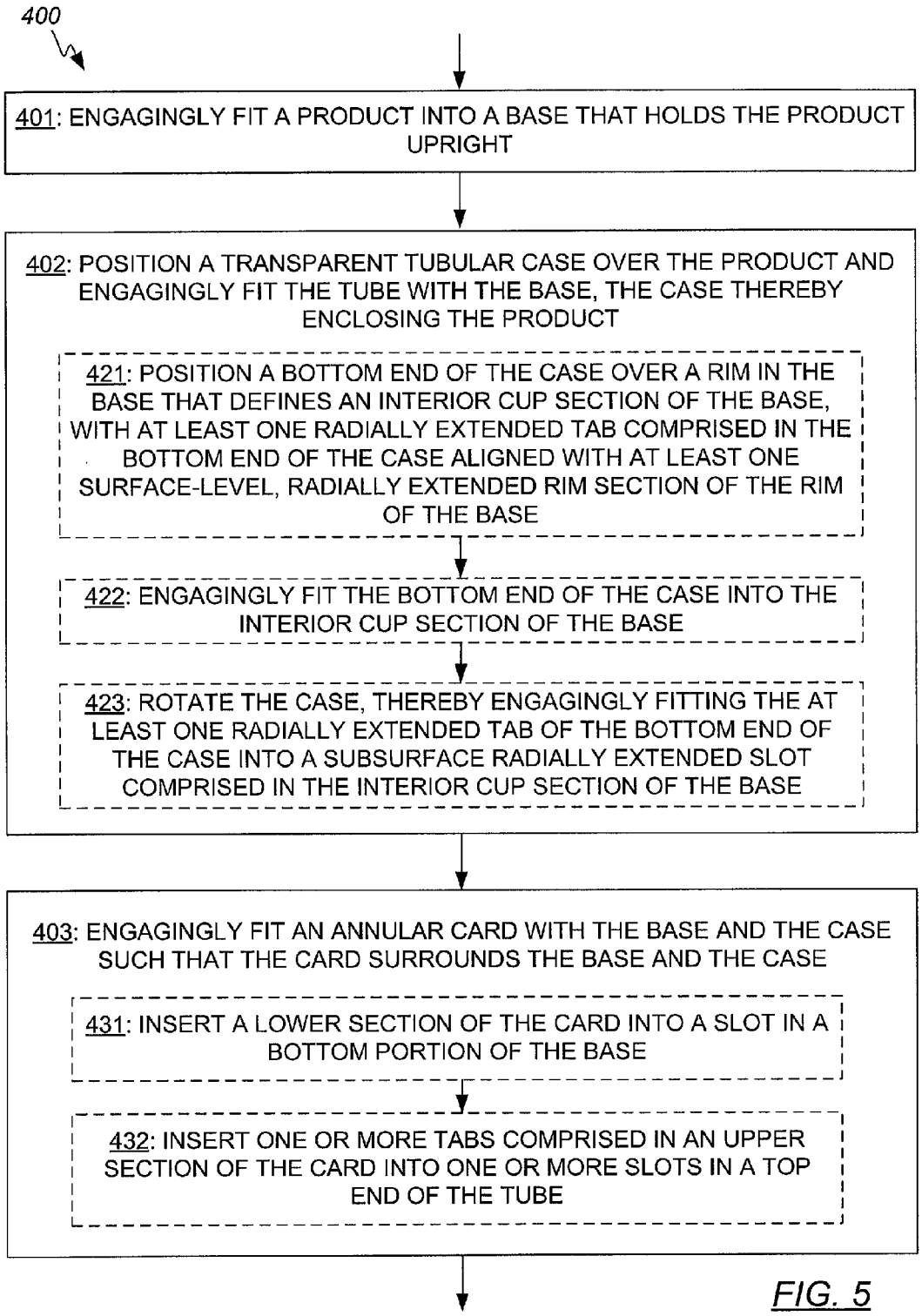
FIG. 5 depicts a flowchart for a method of packaging a product, in accordance with an illustrative embodiment.

FIG. 5 depicts a flowchart for a method 400 of packaging a product, in accordance with another illustrative embodiment, similar to method 300 of FIG. 4 hut with additionally detailed steps. Method 400 includes steps 401, 402, and 403 similar to those of method 300. Step 402 of positioning a transparent tubular case over the product and engagingly fitting the tube with the base, the case thereby enclosing the product, further includes additional steps in this illustrative embodiment. For example, step 402 may also include step 421, of positioning a bottom end of the case over a rim in the base that defines an interior cup section of the base, with at least one radially extended tab comprised in the bottom end of the case aligned with at least one surface-level, radially extended rim section of the rim of the base; step 422, of engagingly fitting the bottom end of the case into the interior cup section of the base; and step 423, of rotating the case, thereby engagingly fitting the at least one radially extended tab of the bottom end of the case into a subsurface radially extended slot comprised in the interior cup section of the base.

Step 403 of engagingly fitting an annular card with the base and tube further includes additional steps as well in this illustrative embodiment. For example, step 403 may also include step 431, of inserting a lower section of the card into a slot in a bottom portion of the base; and step 432, of inserting one or more tabs comprised in an upper section of the card into one or more slots in a top end of the tube.

While various embodiments have been particularly shown and described, it will be understood by those skilled in the art that various combinations of the disclosed elements or changes in detail may be made without departing from the scope of the claims. For example, any of the engaging elements between the base, the case, the card, and the product may be of or may additionally include various types such as an opposing tab and slot combination, opposing card section and slot combination, mated screw threading, simple friction fitting, snapping elements, tape, shrink wrapping, tied string, or other engaging elements. As another example, while the particular example of a firearm cleaning brush is disclosed above, various embodiments may also be used for packaging any other types of products, including other types of tools and particularly other types of firearm maintenance tools, along with any other types of products. Other variations may also be made within the realm of different embodiments, limited only by the metes and bounds of the claims as recited below.

What is claimed is:

1. A package comprising:

a base, comprising:

a bottom portion and a top portion, the bottom portion of the base comprising a bottom surface and a bottom engaging element comprising at least one slot extending onto the bottom surface, and the top portion of the base comprising:

a rim defining an interior cup section, and an engaging element on the rim;

a case, comprising:

a bottom end and a top end, the top end of the case comprising at least one engaging element comprising at least one slot, and the bottom end of the case being configured to engagingly fit with the engaging element on the rim of the top portion of the base; and a card, comprising a lower section, and an upper section, the lower section of the card configured to engagingly fit with the at least one slot in the bottom engaging element of the bottom portion of the base, and the upper section of the card comprising at least one upper section engaging element comprising at least one tab, wherein the tab is configured to engagingly fit with the at least one slot in the top end of the case, such that the base, the case, and the card are configured to be engagingly fitted together with the base and the case positioned within an interior gap in the card, the top portion of the base further comprises at least one surface-level, radially extended rim section with an adjacent subsurface radially extended slot, and in which the bottom end of the case comprises at least one radially extended tab configured to fit through the surface- level, radially extended rim section of the base and to engagingly fit within the radially extended slot of the base, the base further comprises a mount within the interior cup section, the mount comprises an annulus defining a central opening that comprises interior screw threading.

2. The package of claim 1, in which the case comprises a transparent tubular body.

3. The package of claim 1, in which the lower section of the card and the bottom engaging element of the bottom portion of the base are configured to form a flat bottom surface when the lower section of the card is engagingly fitted with the bottom engaging element of the bottom portion of the base.

4. The package of claim 3, wherein the base is capable of supporting the package in an upright position when the flat bottom surface is placed on a surface.

5. The package of claim 1, in which the upper section of the card comprises a first tab and a second tab of the card, and the top end of the case comprises a first slot and a second slot in the case, such that the first tab of the card is configured to conformingly fit within the first slot in the case and the second tab of the card is configured to conformingly fit within the second slot in the case.

6. The package of claim 1, in which the upper section of the card further comprises at least one rack hole disposed above the upper section engaging element.

7. The package of claim 1, in which the card further comprises two side sections extending between the lower section and the upper section, thereby defining an interior gap in the card surrounded by the lower section, the upper section, and the two side sections of the card, such that the base and the case are positioned within the interior gap in the card when the base, the case, and the card are engagingly fitted together.

8. A packaged product comprising:

a base, comprising a bottom portion and a top portion, the bottom portion of the base comprising a slot and the top portion of the base comprising:

a rim defining an interior cup section;

at least one surface-level, radially extended rim section with an adjacent subsurface radially extended slot; and at least one mount within the interior cup section, the at least one mount comprising an annulus defining a central opening that comprises interior screw threading;

at least one product, the product comprising a threaded portion with exterior screw threading, the threaded portion engagingly fitted in the central opening of the mount, such that the product is supported upright on the base;

a transparent tubular case, comprising a bottom end and a top end, the top end of the case comprising at least one slot, and the bottom end of the case comprising at least one radially extended tab configured to fit through the surface-level, radially extended rim section of the base and to engagingly fit within the radially extended slot of the base; and a card, comprising a lower section, an upper section, and two side sections extending between the lower section and the upper section, thereby defining an interior gap in the card surrounded by the lower section, the upper section, and the two side sections of the card, the lower section of the card configured to engagingly fit with the slot in the bottom portion of the base, and the upper section of the card comprising at least one tab configured to engagingly fit with the at least one slot in the top end of the case, such that the base, the case, and the card are configured to be engagingly fitted together with the base and the case positioned within the interior gap in the card.

9. The packaged product of claim 8, in which the at least one product comprises a firearm maintenance tool.

10. The packaged product of claim 9, in which the firearm maintenance tool is a firearm cleaning brush.

11. The packaged tool of claim 10, in which the firearm cleaning brush comprises a spiraling core, and bristles positioned on the core.

* * * * *